US009188377B2

(12) United States Patent
Choi et al.

(10) Patent No.: US 9,188,377 B2
(45) Date of Patent: Nov. 17, 2015

(54) ICE MAKER AND METHOD, AND REFRIGERATOR HAVING THE SAME

(75) Inventors: Sang Geun Choi, Gwangju (KR); Jae Seung Lee, Gwangju (KR); Jae Koog An, Gwangju (KR); Nam Seok Seo, Gwangju (KR); Hyoung Min Go, Gwangju (KR); Young Jin Cho, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1580 days.

(21) Appl. No.: 12/538,349

(22) Filed: Aug. 10, 2009

(65) Prior Publication Data

US 2010/0037631 A1 Feb. 18, 2010

(30) Foreign Application Priority Data

Aug. 13, 2008 (KR) ..... 10-2008-0079407
Jun. 19, 2009 (KR) ..... 10-2009-0055046

(51) Int. Cl.

| | |
|---|---|
| ***F25C 5/18*** | (2006.01) |
| ***F25D 25/02*** | (2006.01) |
| ***F25D 3/02*** | (2006.01) |
| ***F25C 5/02*** | (2006.01) |
| ***F25C 1/22*** | (2006.01) |
| ***F25D 25/00*** | (2006.01) |
| ***F25C 5/00*** | (2006.01) |

(52) U.S. Cl.

CPC ..... *F25C 5/005* (2013.01); *F25C 5/007* (2013.01); *F25C 5/182* (2013.01); *F25C 2400/04* (2013.01)

(58) Field of Classification Search

CPC ..... F25C 5/005; F25C 5/007; F25C 5/182; F25C 2400/04

USPC ..... 62/344, 382, 459, 320, 340, 465, 137; 222/146.6, 108

See application file for complete search history.

(56) References Cited

U.S. PATENT DOCUMENTS

| | | | | |
|---|---|---|---|---|
| 3,436,928 | A * | 4/1969 | Swerbinsky | 62/137 |
| 8,191,379 | B2 * | 6/2012 | Wuesthoff et al. | 62/344 |
| 2006/0272347 | A1 * | 12/2006 | Park | 62/344 |

FOREIGN PATENT DOCUMENTS

| | | |
|---|---|---|
| JP | 2007-120822 | 5/2007 |
| KR | 20-0133006 | 10/1998 |
| KR | 10-2005-0022066 | 3/2005 |
| KR | 10-2006-0114967 | 11/2006 |

OTHER PUBLICATIONS

Office Action, dated Oct. 18, 2012, in corresponding Chinese Application No. 200910166747.3 (6 pp.)

Korean Office Action issued Jul. 9, 2015 in corresponding Korean Patent Application No. 10-2009-0055046.

* cited by examiner

*Primary Examiner* — Frantz Jules
*Assistant Examiner* — Steve Tanenbaum
(74) *Attorney, Agent, or Firm* — Staas & Halsey LLP

(57) ABSTRACT

Disclosed herein are an ice maker and method including an ice container to store ice, and a refrigerator having the same. The ice maker includes an ice making unit that receives water and produces ice from the water, a first ice container that receives the ice separated from the ice making unit, and an ice forwarding unit disposed at one side of the first ice container to guide the ice to be discharged to the outside.

25 Claims, 12 Drawing Sheets

ICE MAKER AND METHOD, AND REFRIGERATOR HAVING THE SAME

CROSS-REFERENCE TO RELATED APPLICATIONS

This application claims the benefit of Korean Patent Applications No. 10-2008-0079407 filed on Aug. 13, 2008 and No. 10-2009-0055.046 filed on Jun. 19, 2009 in the Korean Intellectual Property Office, the disclosure of which is incorporated herein by reference.

BACKGROUND

1. Field

One or more embodiments relate to an ice maker and method including an ice container to store ice and a refrigerator having the same.

2. Description of the Related Art

Generally, refrigerators comprise a refrigerating compartment and a freezing compartment sectionally formed from each other to preserve various food stuff for a long time in an optimum state. The refrigerating compartment stores foods such as vegetables and fruits to be preserved above the freezing temperature whereas the freezing compartment stores foods such as meat and fish to be preserved under the freezing temperature.

Such a freezing compartment is provided with an ice maker that produces ice by freezing water using cold air circulating therein.

The ice maker comprises a tray that receives water to produce ice, and an ice container that stores the produced ice.

Changes in dietary culture have recently caused an increase in the consumption of ice, and accordingly have increased the demand for ice makers which have an ice container capable of storing a quantity of ice.

SUMMARY

Therefore, it is an aspect of one or more embodiments to provide an ice maker capable of storing a quantity of ice.

Additional aspects and/or advantages will be set forth in part in the description which follows and, in part, will be apparent from the description, or may be learned by practice of the invention.

In accordance with one aspect of one or more embodiments, an ice maker includes an ice making unit that receives water and produces ice using the water, a first ice container that receives the ice separated from the ice making unit, and an ice forwarding unit disposed at one side of the first ice container to guide the ice during discharging of the ice.

The ice maker may further include a second ice container that receives the ice being guided through the ice forwarding unit.

The second ice container may be removably mounted to the one side of the first ice container.

The ice maker may further include an opening and closing unit that opens the ice forwarding unit when the second ice container is mounted, and closes the ice forwarding unit when the second ice container is removed.

The opening and closing unit may include a shutter part, and an elastic member supplying elasticity to the shutter part in a direction for closing the ice forwarding unit.

The opening and closing unit may further include a shutter part and a guide shaft guiding movements of the shutter part.

The second ice container may include at least one handle unit.

The second ice container may include a first guide unit to move up and down the shutter part.

The opening and closing unit may include a projection protruded outward from the shutter part, and the first guide unit may receive the projection and guide movements of the projection.

Any one of the opening and closing unit and the second ice container may include a projection while the other one may include a first guide unit that receives the projection and guides movements of the projection.

Movements of the projection may be up and down movements.

One from among the opening and closing unit and the second ice container may further include a projection while the other one may further comprise a first guide unit that receives the projection and guides movements of the projection.

The first guide unit may include an entry guiding part guiding entry of the projection, and an inclination part inclined downward from the entry guiding part.

The first guide unit may further include a movement prevention part extended from the inclination part to prevent the projection from moving.

The second ice container may further include a step part disposed substantially at a same height as the ice forwarding unit.

The second ice container may further include a second guide unit that receives the projection and maintains a closed state of the opening and closing unit during mounting and removal of the second ice container.

The second ice container may include a rail part allowing the second ice container to be efficiently connected to and separated from the one side of the first ice container.

The rail part may be formed on a bottom surface of the second ice container.

The ice making unit may further include an extension rib to guide the ice from the first ice container toward the ice forwarding unit.

The ice making unit may further include an ice making tray.

The ice making tray may have a twist-type structure that transports the ice into the first ice container by twisting, and the extension rib is protruded upward from a sidewall of the ice making tray.

The ice making unit may be mounted at a position corresponding to the ice forwarding unit above the first ice container such that ice transported from the ice making unit is stacked in the first ice container, so as to be inclined towards the ice forwarding unit.

In accordance with another aspect of one or more embodiments, an ice maker includes a first container that receives ice and includes an ice forwarding unit guiding discharge of the received ice, an opening and closing unit that opens and closes the ice forwarding unit, and a second ice container being removably connected adjacent to the first ice container and operating the opening and closing unit when connected in a first direction, thereby opening the ice forwarding unit.

The opening and closing unit may include a shutter part, and an elastic member supplying elasticity to the shutter part in a direction for closing the ice forwarding unit.

The opening and closing unit may include a projection, and the second ice container comprises a first guide unit that receives the projection to guide movements of the projection when the second ice container is connected in the first direction.

The first guide unit may include an entry guiding part guiding entry of the projection, and an inclination part inclined downward from the entry guiding part.

The second ice container may further include a second guide unit that receives the projection and maintains a closed state of the opening and closing unit when the second ice container is connected in a second direction.

The ice maker may further include an ice making unit that produces ice and transports the ice to the first ice container, wherein the ice making unit further includes an extension rib to direct the transported ice in the first ice container toward the ice forwarding unit.

In accordance with a further aspect of one or more embodiments, a refrigerator is equipped with an ice maker therein, wherein the ice maker may include an ice making unit receiving water and producing ice from the water, a first ice container receiving the ice separated from the ice making unit, and a second ice container disposed at one side of the first ice container to receive the separated ice from the first ice container.

The refrigerator may further include an opening and closing unit that opens the one side of the first ice container when the second ice container is connected, and closes the one side of the first ice container when the second ice container is separated.

The opening and closing unit may include a shutter part disposed at the one side of the first ice container and including a projections, and an elastic member that supplies elasticity to the shutter part in a direction for closing the one side of the first ice container, and the second ice container comprises a first guiding unit receiving the projection and guiding up and down movements of the projection.

The one side of the first ice container may be opened as the second ice container is connected to the first ice container in a certain direction, and is closed as the second ice container is connected to the first ice container in the opposite direction.

The one side of the first ice container may be opened as the second ice container is connected to the first ice container on one side of the second ice container, and the one side of the first ice container may be closed as the second ice container is connected to the first ice container on another side of the second ice container.

In accordance with a further aspect of one or more embodiments, a refrigerator includes an ice maker and a dispenser to discharge ice from the ice maker to the outside, and the ice maker may include an ice making unit that produces ice and separates the ice therefrom, a first ice container that receives the ice being separated from the ice making unit, a transport unit mounted in the first ice container to transport the ice to the dispenser, a second ice container removably mounted to the first ice container, and an opening and closing unit provided to at least one of the first and the second ice containers to open one side of at least one of the first and the second ice containers upon the second ice container being removably mounted.

In accordance with a further aspect of one or more embodiments, a refrigerator having an ice making area therein, includes a first ice container receiving ice, the first ice container being disposed at one side of the ice making area, an opening and closing unit opening and closing one side of the first ice container, and a partition member dividing another side of the ice making area into a first space and a second space, wherein at least a part of the ice received in the first ice container is transported to the first space according to operation of the opening and closing unit, the opening and closing unit being operated upon the first ice container being filled with the ice by more than a predetermined quantity.

The refrigerator may further include a second ice container received in and separated from the first space, and opening the one side of the first ice container by operating the opening and closing unit upon the second ice container being received in the first space in a first direction.

The opening and closing unit may maintain a closed state of the one side of the first ice container upon the second ice container being received in the first space in a second direction.

The partition member may divide the other side of the ice making area by a predetermined ratio so that the second ice container can be selectively received in the first space or the second space.

The second ice container may include a rail part to be efficiently received in the first space, and the partition member comprises a guide formed on a surface thereof defining the first space, corresponding to the rail part.

The refrigerator may further include an ice making unit disposed above the first ice container to produce ice and transport the ice to the first ice container, wherein the ice making unit further comprises an extension rib to guide the ice transported to the first ice container.

The ice making unit may have a twist-type structure transporting the ice by twisting, and the extension rib is protruded upward from a sidewall of the ice making unit.

In accordance with a further aspect of one or more embodiments, a method of ice making may include receiving water into an ice making unit, receiving ice separated from the ice making unit into a first ice container, and guiding the ice in the first ice container to be discharged.

The method of ice making may further include allowing the ice to be guided into a second ice container by attaching the second ice container to the first ice container on a side of the second ice container, and preventing the ice from being guided into the second ice container by attaching the second ice container to the first ice container on another side of the second ice container.

The method of ice making may further include allowing storage of another second ice container above the second ice container.

The method of ice making may further include guiding the ice separated from the ice making unit to fall near a second ice container.

The method of ice making may further include detecting an ice-full state in the first ice container due to uneven piling of the ice in the first ice container, and distributing evenly the ice in the first ice container upon detecting an ice-full state.

The distributing may simultaneously forward the ice to a second ice container while distributing evenly the ice in the first ice container.

As described above, according to the ice maker and the refrigerator having the same, a sufficient quantity of ice may be stored using a plurality of ice containers.

In addition, simply by mounting the second ice container to the first ice container, the ice being separated from the ice maker may be distributed evenly to the first and the second ice containers.

Moreover, by shifting a mounting direction of the second ice container using the first and second guide units provided to the second ice container, the second ice container may be used as an auxiliary container of the first ice container or for other purposes.

Since the ice making unit is provided with the extension rib, the ice from the ice making unit may be received near the second ice container in the first ice container. As a result, the ice in the first ice container is efficiently transported to the second ice container.

Furthermore, the partition member provided in an ice making area enables storage of a plurality of the second ice containers, thereby enhancing the space utilization.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
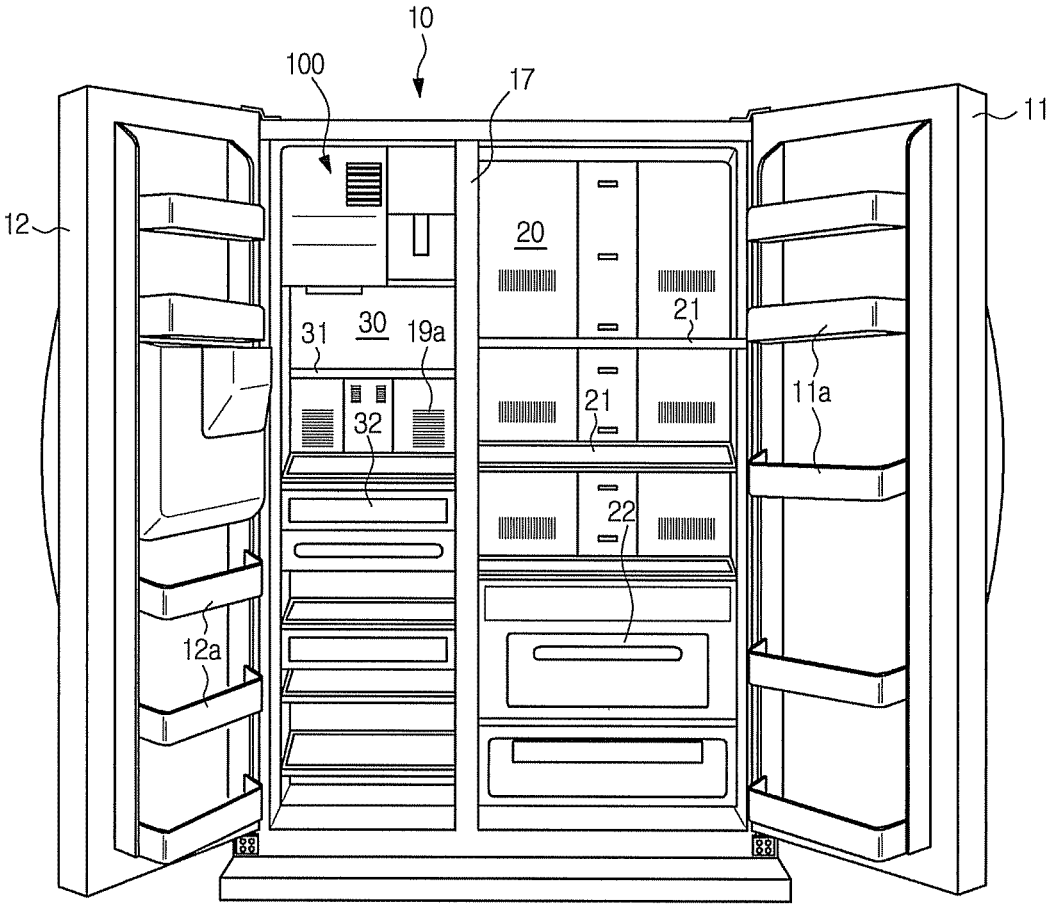
FIG. 1 illustrates a perspective view of the overall appearance of a refrigerator according to one or more exemplary embodiments.

Reference will now be made in detail to the embodiments, examples of which are illustrated in the accompanying drawings, wherein like reference numerals refer to the like elements throughout. The embodiments are described and explained below by referring to the figures.

Figure 2:
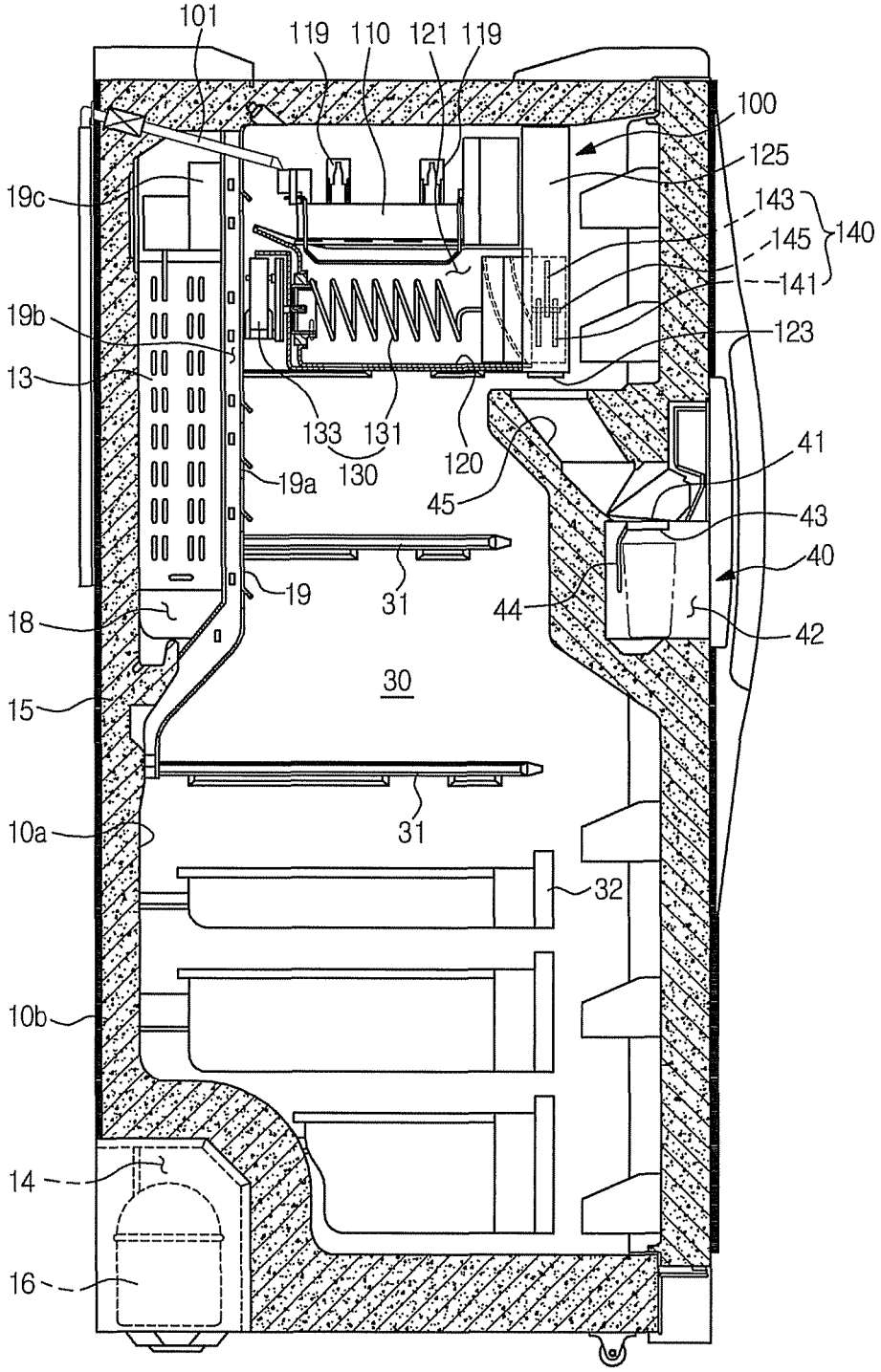
FIG. 2 illustrates a longitudinal-sectional view of a freezing compartment of the refrigerator.
Figure 3:
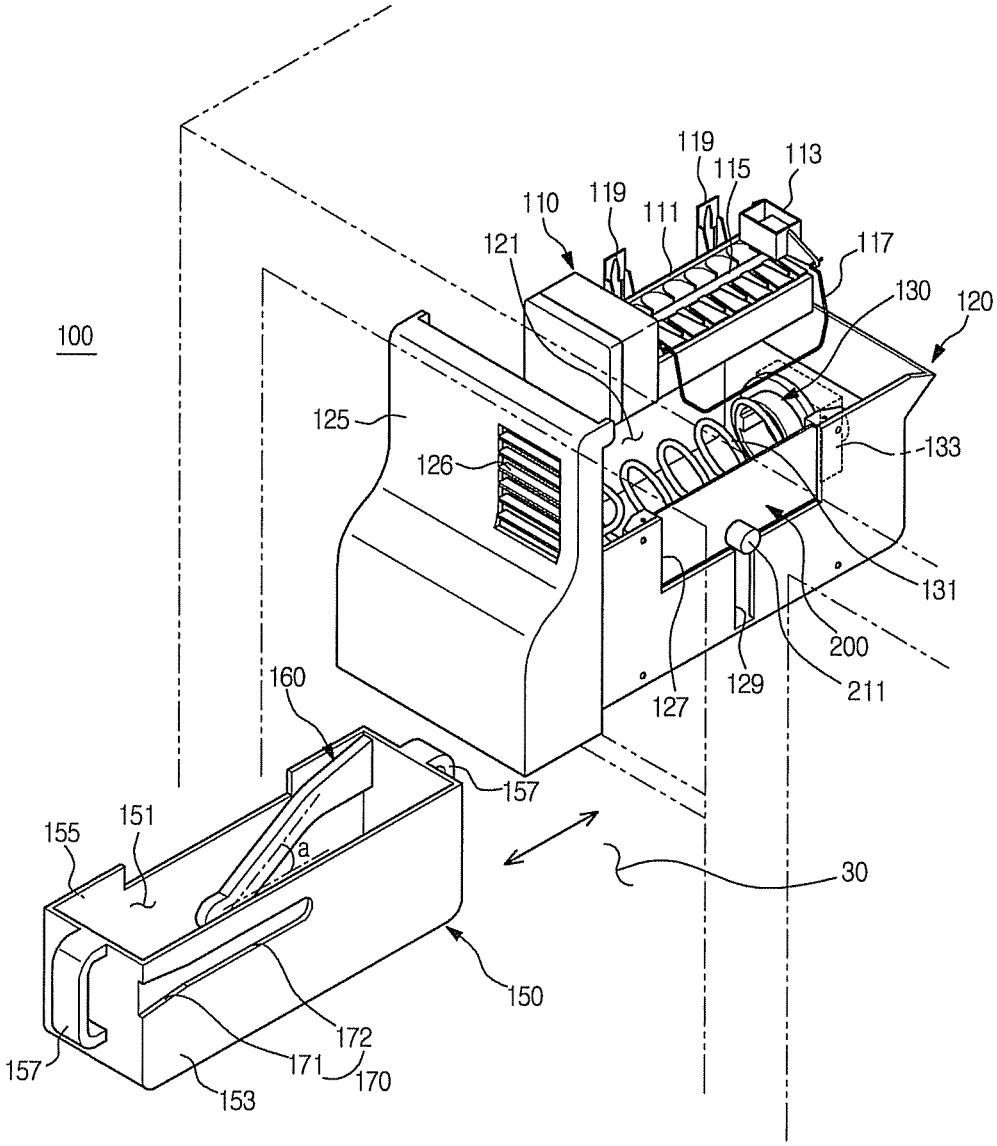
FIG. 3 illustrates a perspective view of an ice maker of the refrigerator according to an exemplary embodiment.

FIG. 1 illustrates a perspective view of the overall appearance of a refrigerator according to one or more exemplary embodiments and FIG. 2 illustrates a longitudinal-sectional view of a freezing compartment of the refrigerator. FIG. 3 illustrates a perspective view of an ice maker of the refrigerator according to an exemplary embodiment.

As shown in FIG. 1 and FIG. 2, the refrigerator according to one or more embodiments comprises a main body 10 constituting the exterior appearance thereof, storage compartments 20 and 30 formed at upper and lower parts inside the main body 10, doors 11 and 12 to open and close opened front sides of the respective storage compartments 20 and 30, an ice maker 100 mounted in a freezing compartment 30 of the storage compartments 20 and 30, and a dispenser 40 to discharge ice produced by the ice maker 100 to a front side of the door 12.

An evaporator 13 is mounted to a rear wall of the main body 10 to generate cold air. A machinery chamber 14 is partitioned off at a lower rear part of the main body 10. In addition, a foamed material 15 is stuffed between an inner cabinet 10*a* and an outer cabinet 10*b* of the main body 10 in order for thermal insulation.

In the machinery chamber 14 of the main body 10, electric parts including a compressor 16 are mounted. The storage compartments 20 and 30 are disposed above the machinery chamber 14.

It is apparent that component parts such as a condenser (not shown) and an expander (not shown) constituting a refrigerating cycle are equipped in the main body 10.

The storage compartments 20 and 30 may be sectioned by a vertical partition 17 into a refrigerating compartment 20 disposed on the right of the vertical partition 17 in the drawing to store food in a refrigerated state, and a freezing compartment 30 disposed on the left of the vertical partition 17 to store food in a frozen state.

An internal panel 19 is mounted to rear sides of the storage compartments 20 and 30, thereby defining a cold air generating chamber 18 generating the cold air to be supplied to the storage compartments 20 and 30. In the cold air generating chamber 18, an evaporator 13 is mounted to generate the cold air through heat exchange with the ambient air.

The inner panel 19 comprises a plurality of exhaustion ports 19*a* arranged at predetermined intervals to exhaust the cold air evenly into the storage compartments 20 and 30, a cold air path 19*b* which guides the cold air toward the exhaustion ports 19*a*, and a circulation fan 19*c* which drives the cold air heat-exchanged passing through the evaporator 13 to the cold air path 19*b* and the exhaustion parts 19*a*.

Shelves 21 and 31 and storage boxes 22 and 32 are provided respectively in the storage compartments 20 and 30 to store the food.

The doors 11 and 12 are provided as a pair so as to open and close the refrigerating compartment 20 and the freezing compartment 30, respectively. More specifically, the doors 11 and 12 comprise a refrigerating compartment door 11 pivotably mounted to the main body 10 to open and close the refrigerating compartment 20, and a freezing compartment door 12 pivotably mounted to the main body 10 to open and close the freezing compartment 30.

Additionally, a plurality of door shelves 11*a* and 12*a* are mounted to inner sides of the refrigerating compartment door 11 and the freezing compartment door 12, respectively, to further store food.

The freezing compartment door 12 is equipped with the dispenser 40 enabling a user to take out some objects such as water and ice without having to directly opening the freezing compartment door 12. In addition, the ice maker 100 is provided to an upper part of the freezing compartment 30 to produce and supply ice for the dispenser 40.

The dispenser 40 comprises a withdrawal unit 42 formed as a space recessed inwardly from a front side of the freezing compartment door 12 and provided with a withdrawal opening 41 through which the objects are taken out. The dispenser 40 further comprises an opening and closing member 43 which opens and closes the withdrawal opening 41, an operation lever 44 mounted to the withdrawal unit 42 to operate the opening and closing member 43 and also operate the ice maker 100 provided in the freezing compartment 30, and an ice discharge path 45 fluidly connecting an inner surface and an outer surface of the freezing compartment door 12 with each other so as to guide the ice produced from the ice maker 100 to the withdrawal opening 41.

The ice maker 100 is disposed at an upper space in the freezing compartment 30. As shown in FIG. 2 and FIG. 3, the ice maker 100 comprises an ice making unit 110 producing the ice, a first ice container 120 storing the ice produced in the ice maker 110, a transport unit 130 transporting the ice stored in the first ice container 120, a crushing unit 140 making the ice transported by the transport unit 130 into crushed ice, and a second ice container 150 removably mounted to the first ice container 120 to distributively store the ice of the first ice container 120.

The ice making unit 110 comprises an ice making tray 111 producing ice from water supplied from the outside, being formed of metal, a water supply cup 113 supplying the water to the ice making tray 111, a scraper 115 discharging the ice from the ice making tray 111, a driving motor (not shown) driving the scraper 115, a heater (not shown) melting one side of the ice contacting the ice making tray 111 in order to facilitate moving of the ice by the scraper 115, and an ice-full state sensing lever 117 detecting whether the first ice container 120 is filled with the ice.

The ice making unit 110 is fixed to the freezing compartment 30 through a plurality of brackets 119 connected to one of side walls of the freezing compartment 30. At the rear side of the main body 10, a water supplying pipe 101 is extended up to an upper part of the ice making unit 110 to supply the water for producing the ice to the ice making unit 110.

Although not shown, differently from as described above, the ice making unit 110 may be structured to have an ice making tray formed by injection molding of resin and to discharge the ice downward from the ice making tray by rotating and twisting the ice making tray.

The first ice container 120 is disposed at a lower part of the ice making unit 110, and comprises a first receiving part 121 opened upward to receive the ice dropping from the ice making unit 110 and extended in a forward and backward direction of the ice making unit 110, an ice discharge opening 123 disposed at a front lower part to discharge the produced ice, and a cover 125 formed in front of the first ice container 120, thereby shielding the front of the ice maker 100.

The first ice container 120 has a drawer form to be taken in and out of the freezing compartment 30. The cover 125 has a penetration hole 126 so that the cold air is circulated between the freezing compartment 30 and the ice maker 100.

The transport unit 130 comprises a transporting screw member 131 and a transport motor 133. The transporting screw member 131 is rotatably mounted inside the first ice container 120 to help the discharging of the ice of the first ice container 120 toward the ice discharge opening 123. The transport motor 133 is fixed to a rear side of the first ice container 120 to rotate the transporting screw member 131. The transporting screw member 131 is separated from a shaft of the transport motor 133 when the first ice container 120 is separated from the freezing compartment 30, and connected to the shaft of the transport motor 133 when the first ice container 120 is mounted to the freezing compartment 30.

The crushing unit 140 is disposed near the ice discharge opening 123 of the first ice container 120. As shown in FIG. 2, the crushing unit 140 comprises a static blade 141 fixed at the ice discharge opening 123, and a plurality of rotary blades 143 rotated relative to the static blade 141, being connected to a shaft 145 extended from the transporting screw member 131 of the transport unit 130. Therefore, as the transporting screw member 131 is rotated by the transport motor 133, the rotary blades 143 are accordingly rotated.

The crushing unit 140 may comprise a shutter (not shown) partly opening and closing the ice discharge opening 123, thereby selectively discharging cubed ice or crushed ice through the ice discharge opening 123. Since the opening and closing structure of the shutter can be achieved by generally known art, the structure will not be shown in detail in the drawings.

For instance, the shutter may comprise an opening and closing member rotatably mounted to the ice discharge opening 123, a solenoid operator controlling the opening and closing operation of the opening and closing member, and a connection member interconnecting the solenoid operator with the opening and closing member.

In the above described structure, after the ice making tray 111 is supplied with water through the water supplying pipe 101 and left for a predetermined time, the water in the ice making tray 111 is frozen by the cold air circulating in the freezing compartment 30, thereby producing cubed ice having a predetermined size. The ice cubes are dropped into the first ice container 120 by the operations of the heater (not shown) and the scraper 115, filling the first ice container 120.

When the ice-full state sensing lever 117 detects a full ice state in the first ice container 120 filled with the ice supplied from the ice making tray 111, the ice producing operation is not performed any more.

When the user takes out the ice through the dispenser 40, the transport unit 130 and the opening and closing device (not shown) are operated so that the ice being discharged through the ice discharge opening 123 is taken out to the withdrawal unit 42 through the ice discharge path 45. When the ice in the first ice container 120 is discharged and therefore the full ice state is removed, the ice making tray 111 is supplied with water again to produce ice. Such ice producing and discharging processes are performed under the control of a control unit (not shown) mounted to the ice maker 100.

The ice in the ice maker 100 is supplied to the user by the dispenser 40 through the above serial processes. Sometimes, a quantity of ice may be needed at once. Unless lots of ice is prepared in storage beforehand, it is difficult to obtain the desired quantity of ice because the ice producing speed is restricted.

Therefore, it is necessary to produce and store lots of ice in advance so that the ice may be supplied by a desired quantity at any time. For this, according to one or more embodiments, the second ice container 150 is provided in addition to the first ice container 120.

Therefore, the ice separated from the ice making tray 111 is stored in the first receiving part 121 of the first ice container 120 and, when the first receiving part 121 is filled with the ice by over a predetermined quantity, some of the ice is automatically supplied into the second ice container 150 without the user's dedicated manipulation.

Hereinafter, the structure of the ice maker 100 will be described in greater detail.

According to one or more embodiments, the second ice container 150 is mounted to one side of the first ice container 120, and an ice forwarding unit 127 is provided to one side of the first ice container 120 to discharge the ice to the second ice container 150. The ice forwarding unit 127 is equipped with an opening and closing unit 200 that opens and closes the ice forwarding unit 127.

More particularly, the ice forwarding unit 127 is formed at one side of the first ice container 120, as an opening disposed at a predetermined height such that, when the first ice container 120 is filled with the ice by a predetermined quantity, some of the ice escapes from the first ice container 120 through the ice forwarding unit 127.

Figure 4:
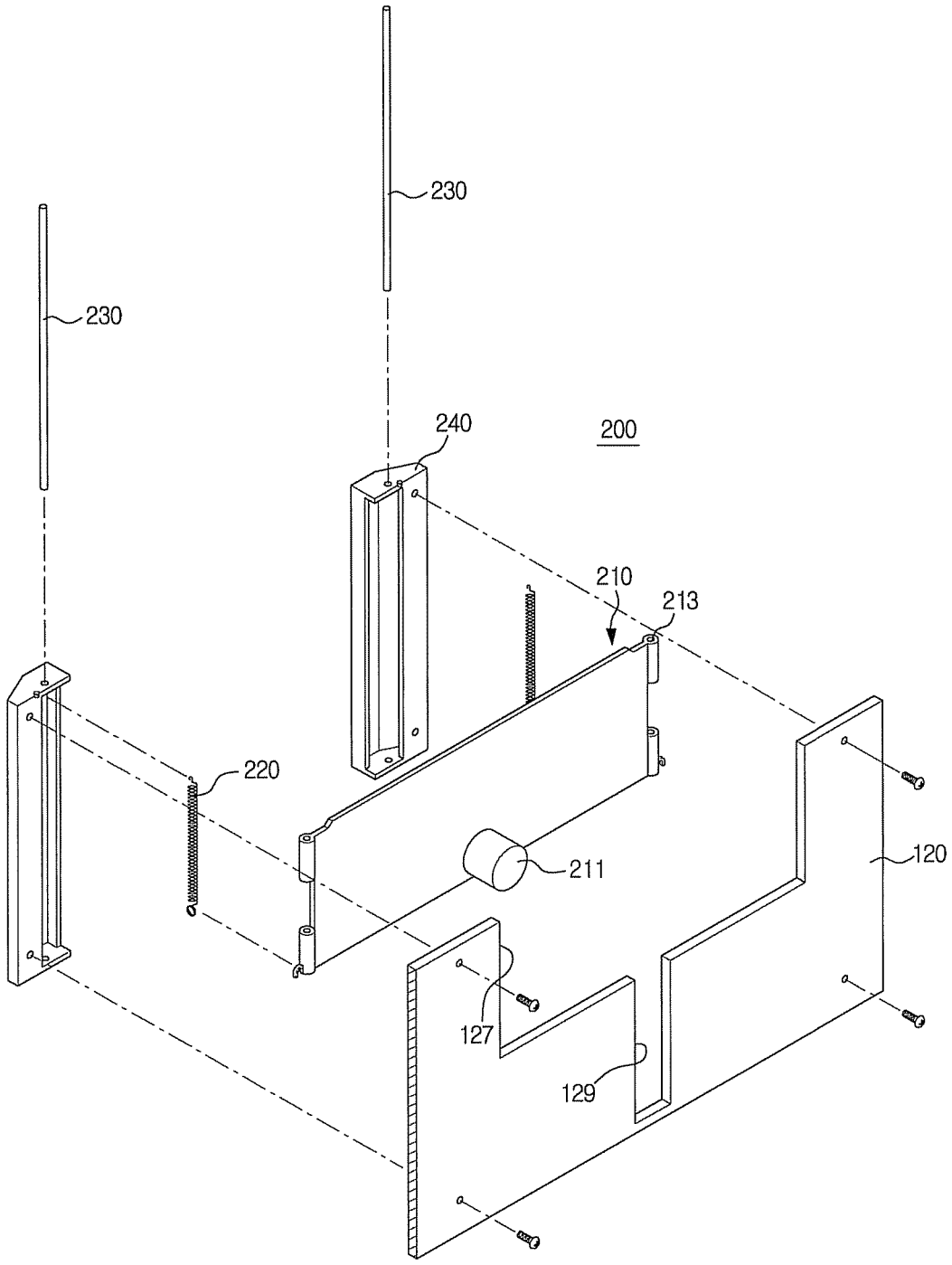
FIG. 4 illustrates an exploded perspective view of an opening and closing unit of the ice maker.
Figure 5:
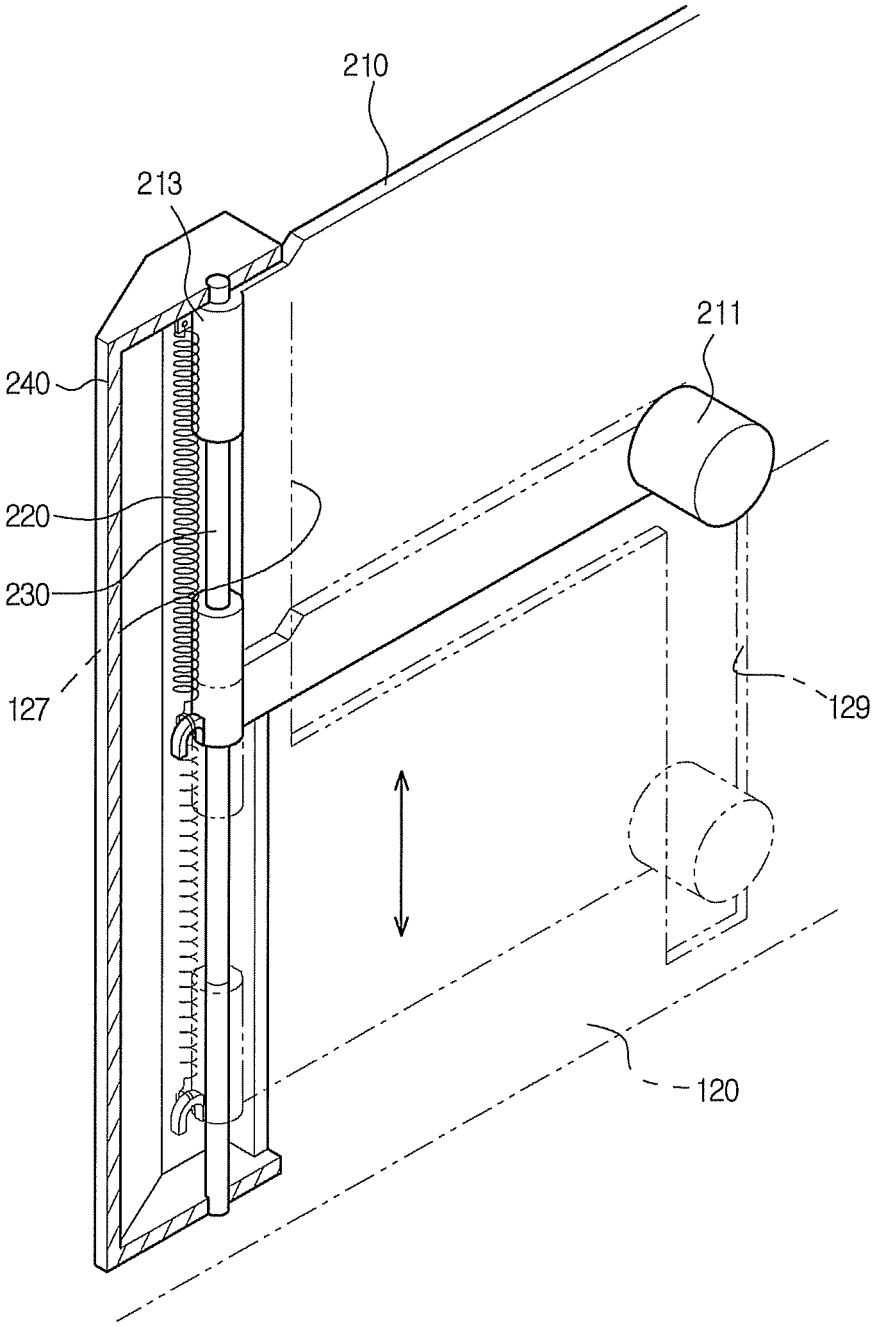
FIG. 5 illustrates a view of the operation of the opening and closing unit of the ice maker.

FIG. 4 is an exploded perspective view of the opening and closing unit 200 of the ice maker 100 and FIG. 5 shows the operation of the opening and closing unit 200.

The ice forwarding unit 127 is equipped with the opening and closing unit 200 for opening and closing thereof.

Referring to FIG. 3, FIG. 4, and FIG. 5, the opening and closing unit 200, which is moved up and down with respect to the ice forwarding unit 127, comprises a shutter part 210 opening and closing the ice forwarding unit 127, an elastic member 220 supplying elasticity to the shutter part 210 in a closed state, a guide shaft 230 guiding an up and down movement of the shutter part 210, and a mounting member 240 fixing the guide shaft 230.

The shutter part 210 has a size corresponding to the ice forwarding unit 127 and includes a projection 211 projected outward from a lower middle part thereof.

The projection 211 may be rotatably mounted to the shutter part 210 to facilitate connection and separation of the shutter part 210 with respect to the second ice container 150.

Corresponding to the projection 211, a cut part 129 is formed at a lower part of the ice forwarding unit 127, being cut out in a vertical direction to enable an up and down movement of the projection 211.

In addition, a guide hole 213 to insert the guide shaft 230 is vertically formed on both sides of the shutter part 210, so that the shutter part 210 fits with the guide shaft 230 and stably moved up and down along the guide shaft 230.

The elastic member 220 may be implemented by a coil spring. In this case, one end of the elastic member 220 is fixed to an upper part of the mounting member 240 while the other end is fixed to the shutter part 210.

Therefore, without any external force applied, the shutter part 210 maintains the ice forwarding unit 127 in the closed state by the elasticity of the elastic member 220. When a predetermined external force is applied downward to the projection 211, however, the elastic member 220 is elastically deformed and accordingly the shutter part 210 is moved down along the guide shaft 230, thereby opening the ice forwarding unit 127.

When the external force is removed afterward, the shutter part 210 is moved up along the guide shaft 230 by an elastic recovery force of the elastic member 220, thereby closing the ice forwarding unit 127.

Thus, the shutter part 210 is moved up and down by the external force applied thereto, thereby opening and closing the ice forwarding unit 127. Here, the external force to move down the shutter part 210 may be supplied as the second ice container 150 is mounted to the side of the first ice container 120.

Hereinafter, connecting and separating operations of the second ice container 150 will be explained in greater detail.

Figure 6:
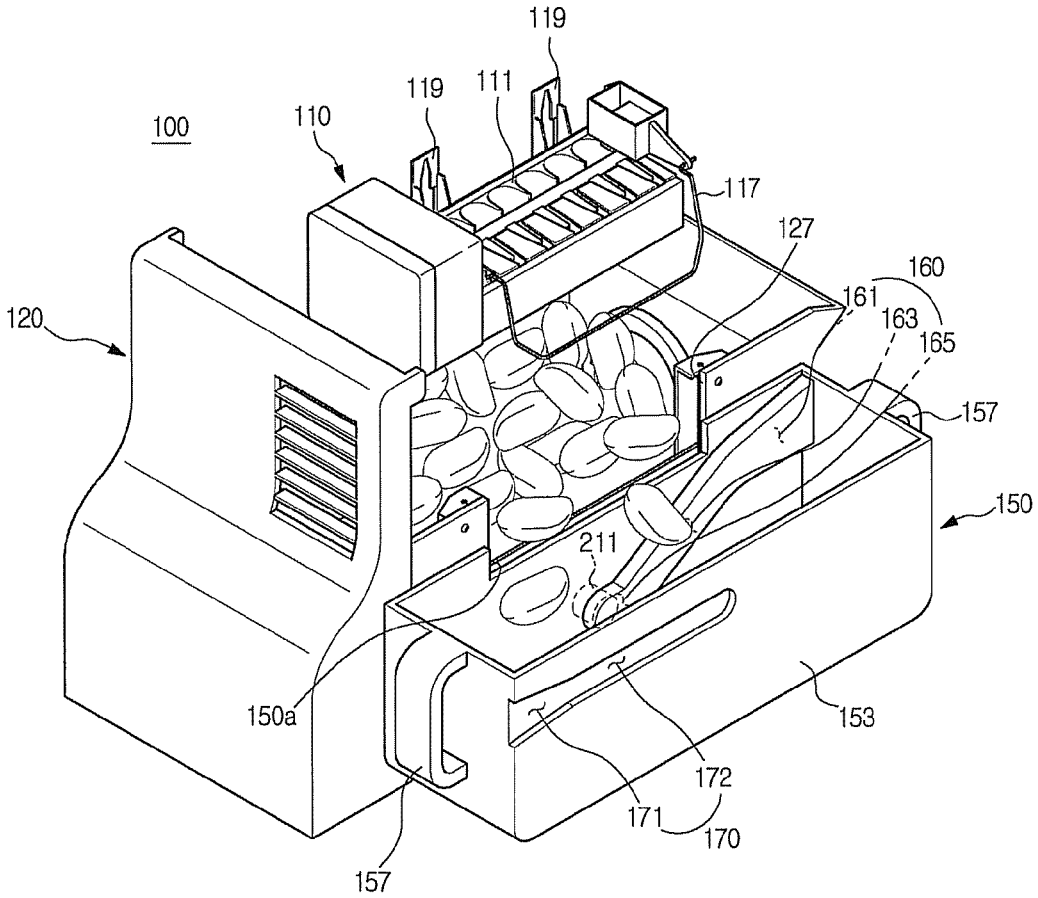
FIG. 6 and FIG. 7 illustrate perspective views of first and second ice containers of the ice maker being assembled.
Figure 7:
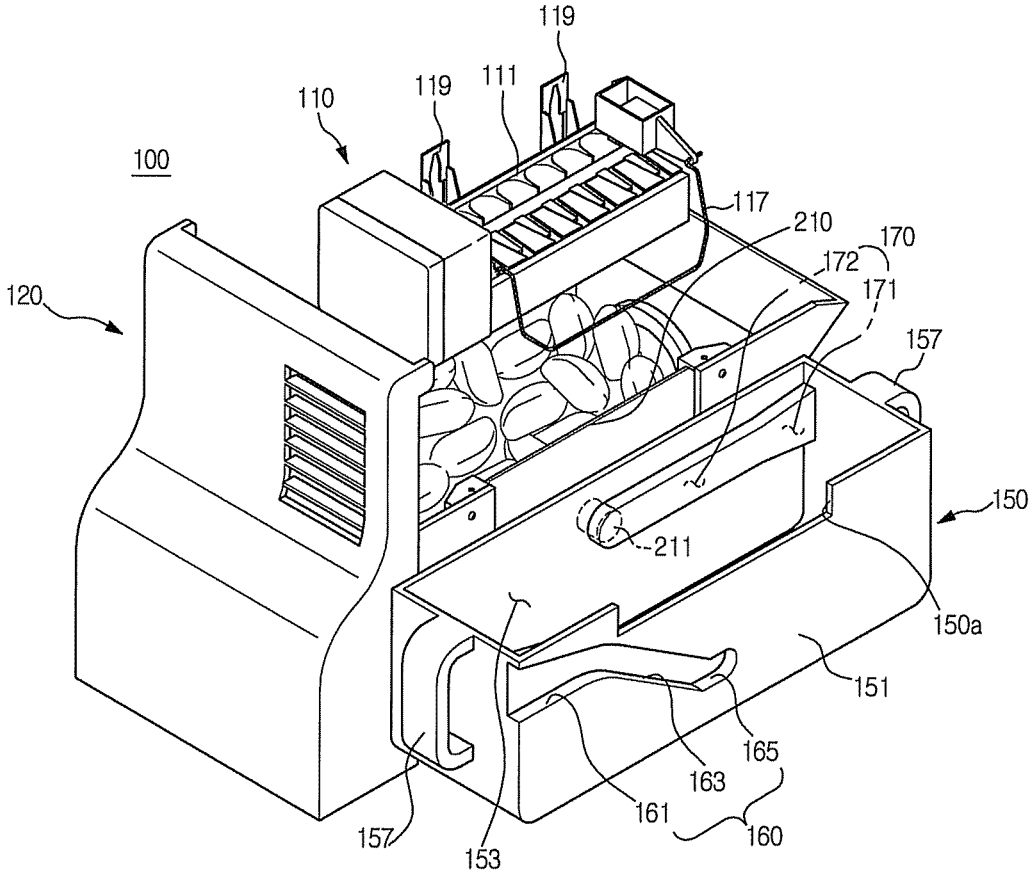
Figure 8:
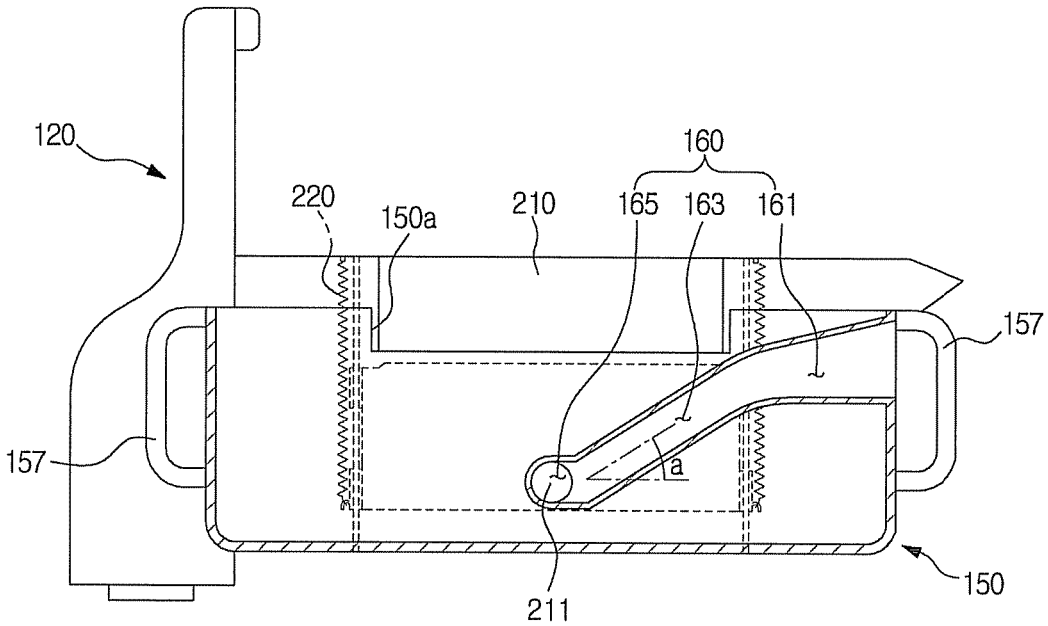
FIG. 8 illustrates a side view of the assembled state of the first and the second ice containers of the ice maker.

FIG. 6 and FIG. 7 illustrate perspective views of first and second ice containers of the ice maker, being assembled. FIG. 8 illustrates a side view of the assembled state of the first and the second ice containers of the ice maker 100.

The second ice container 150 may have a similar length to a length of the first ice container 120 as shown in FIG. 3. In addition, a width of the second ice container 150 may be properly determined so that the sum of widths of the first and the second ice containers 120 and 150 corresponds to an inner width of the freezing compartment 30.

Through such a structure, bilateral movements of the second ice container 150 may be restrained as much as possible when the second ice container 150 is inserted in a state where the first ice container 120 is fixed to the freezing compartment 30 (FIG. 1). Furthermore, the second ice container 150 may be securely connected with the first ice container 120.

Referring to FIG. 3 and FIG. 6, the second ice container 150 comprises a second receiving part 151 formed therein to receive the ice, and guide units 160 and 170 disposed on both sides, being depressed inward to insert the projection 211.

The second ice container 150 may further comprise a handle unit 157 on at least one of a front side and a rear side thereof for the user to conveniently connect and separate the second ice container 150. In this embodiment, the handle unit 157 is provided to both front and rear sides of the second ice container 150.

The guide units 160 and 170 comprise a first guide unit 160 to move down the projection 211 during mounting of the second ice container 150, and a second guide unit 170 to maintain an initial position of the projection 211 even after the second ice container 150 is mounted.

Referring to FIGS. 6 and 8, the first guide unit 160 comprises an entry guiding part 161 formed on one side surface of the second ice container 150 to guide entry of the projection 211 when the second ice container 150 is mounted, an inclination part 163 sloping down from the entry guiding part 161 to move the projection 211 downward along the inclination part 163, and a movement prevention part 165 extended from an end of the inclination part 163 to prevent movement and separation of the projection 211 although the elasticity of the elastic member 220 is exerted in a direction for pushing the shutter part 210 upward.

The entry guiding part 161 is gradually narrowed in width from the front side toward the rear side. Therefore, although the user mounts the second ice container 150 at a wrong height, the projection 211 may be smoothly inserted in the entry guiding part 161.

Since the inclination part 163 is sloped downward from the entry guiding part 161, the projection 211 inserted in the entry guiding part 161 is moved down along the inclination part 163, by being pushed by an upper surface of the inclination part 163 as the second ice container 150 advances.

When connecting and separating the second ice container 150, the up and down movement speed of the shutter part 210 is varied according to an inclined angle 'a' of the inclination part 163. When the inclined angle 'a' is relatively large, the connection and separation of the second ice container 150 may be performed inefficiently. When the inclined angle 'a' is relatively small, on the other hand, the movement speed of the shutter part 210 is decreased and the ice existing between the first and the second ice containers 120 and 150 may even drop to the outside by the operation of the shutter part 210.

Accordingly, the inclined angle 'a' may be determined and applied, by considering the connection and separation efficiency of the second ice container 150 and prevention of escape of the ice.

When the second ice container 150 is further advanced until the projection 211 is inserted in the movement prevention part 165, the shutter part 210 maintains the ice forwarding unit 127 in the opened state because a weight of the second ice container 150 is greater than the elasticity of the elastic member 220.

Furthermore, a step part 150*a* may be additionally formed on the side surface of the second ice container 150 where the first guide unit 160 is formed, being stepped down by a width corresponding to the ice forwarding unit 127.

Since the step part 150*a* is stepped down to a similar height to the ice forwarding unit 127 in the opened state, the ice overflowing from the first ice container 120 to the second ice container 150 may be restrained from dropping out of the second ice container 150.

When the second ice container 150 is mounted to the side of the first ice container 120 and the ice is produced with the ice forwarding unit 127 opened, after the first ice container 120 is filled with a predetermined quantity of the ice, some of the ice being dropped from the ice making tray 111 is forwarded to the second ice container 150 through the ice forwarding unit 127. Accordingly, the ice begins to be stored in the second ice container 150.

When the full ice state of the first ice container 120 is detected by the ice-full state sensing lever 117 of the ice making unit 110, in some cases, the ice may be inclined to some part in the first ice container 120, resulting in an uneven pile of the ice in the first ice container 120.

To this end, in reference to FIG. 3, the control unit (not shown) operates the transporting screw member 131 of the transport unit 130 for a predetermined time to mix up the ice when the full ice state is detected. Therefore, the ice being mixed is evenly distributed within the first ice container 120 and, simultaneously, partly forwarded to the second ice container 150 through the ice forwarding unit 127. Thus, the ice stored in the first ice container 120 may be passed over to the second ice container 150 by operating the transport unit 130 in spite of detection of the full ice state, and accordingly the full ice state is removed and the ice producing operation may be continued, thereby enabling production and storage of more ice.

Referring to FIGS. 2 and 3, when the user needs the ice, the user operates the operation lever 44 of the dispenser 40, thereby driving the transport unit 130. The ice is then moved by the transport unit 130, and partly forwarded to and stored in the second ice container 150, on a side 151 of the second ice container, through the ice forwarding unit 127.

The second ice container 150 includes the second guide unit 170 disposed on the other side 153, being depressed substantially in a horizontal direction.

The second guide unit 170 comprises an entry guiding part 171 functioning in the same manner as the entry guiding part 161 of the first guide unit 160, and a horizontal part 172 extended horizontally to prevent the projection 211 inserted in the entry guiding part 171 from moving up and down.

Accordingly, as shown in FIG. 7, the projection 211 maintains its initial state while the second ice container 150 is being mounted to the first ice container 120 through the second guide unit 170, and therefore the shutter part 210 maintains the ice forwarding unit 127 in the closed state.

That is, when the user estimates that the second ice container 150 is full of ice, when the user does not need a great quantity of the ice, or when the user wants to use the second ice container 150 for another purpose rather than storage of the ice, the second ice container 150 may be connected to the first ice container 120 through the second guide unit 170 so that the ice in the first ice container 120 is not forwarded to the second ice container 150.

Although only an exemplary embodiment has been explained so far regarding the ice forwarding unit 127 at the first ice container 120, one or more embodiments are not limited to this structure. In other words, one of ordinary skill would recognize the ice forwarding unit 127 may be provided to the second ice container 150 while the opening and closing unit 200 may also be provided to the second ice container 150.

Hereinafter, a refrigerator according to another exemplary embodiment will be explained.

The only distinctive feature of this other exemplary embodiment from the previous exemplary embodiment is in the structure of the ice making unit while the other structures are almost the same.

In the following description, the same structures and elements as in the previous exemplary embodiment will be cited by the same reference numerals and detailed description thereof will be omitted.

Figure 9:
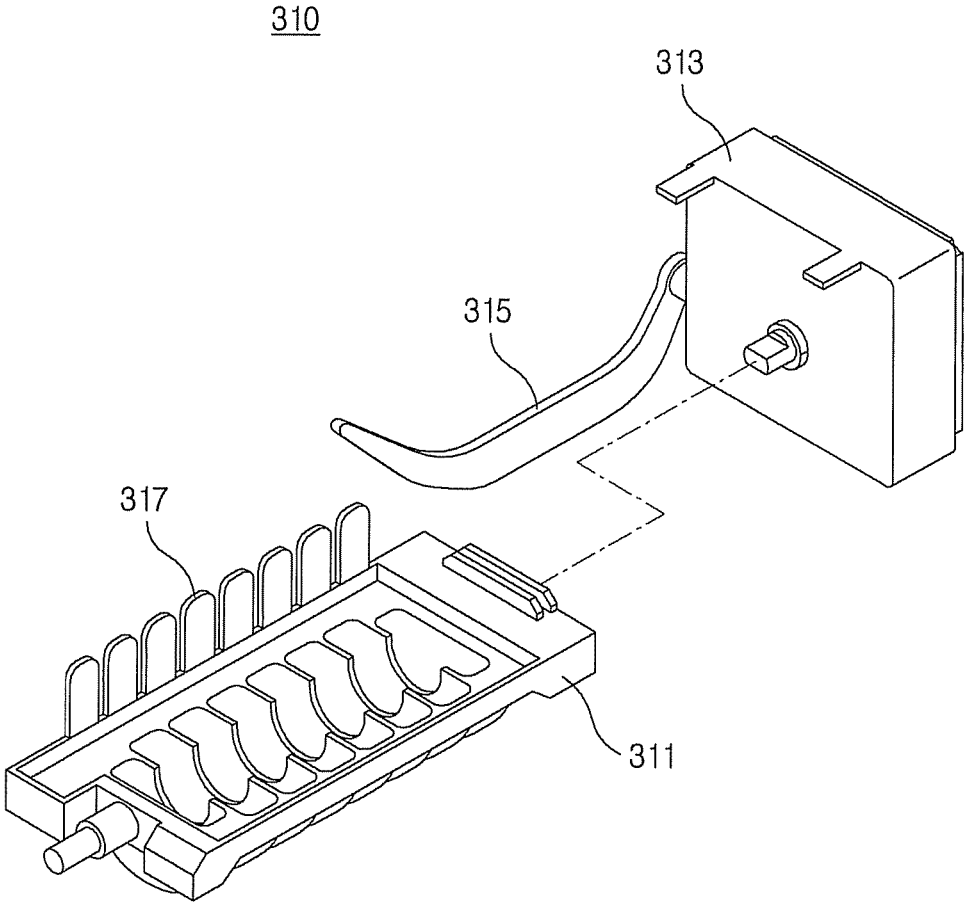
FIG. 9 illustrates an exploded perspective view of an ice making unit according to another exemplary embodiment.
Figure 10:
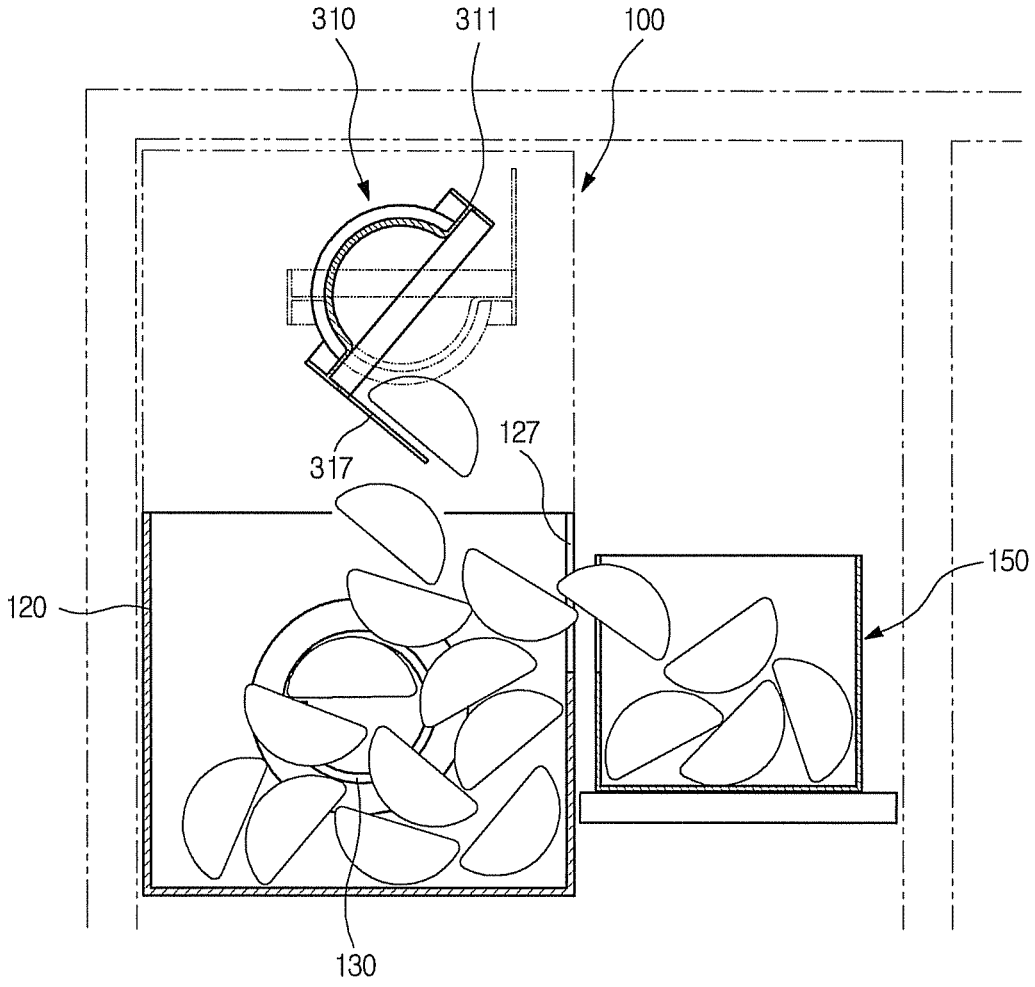
FIG. 10 illustrates an operation view of the ice making unit of the other exemplary embodiment.

FIG. 9 is an exploded perspective view of an ice making unit 310 according to another exemplary embodiment and FIG. 10 is an operation view of the ice making unit 310.

As shown in FIG. 9 and FIG. 10, an ice making unit 310 of the present exemplary embodiment includes an ice making tray 311 formed by injection molding of resin to make ice from water supplied from the outside, a water supply cup (not shown) to supply water to the ice making tray 311, a driving motor 313 rotating the ice making tray 311 so as to discharge the ice from the ice making tray 311, and an ice-full state sensing lever 315 detecting whether the first ice container 120 is fully filled with the produced ice.

The ice making unit 310 has a general twist-type structure in which the ice making tray 311 is rotated and twisted, thereby transporting the ice to the first ice container 120.

Referring to FIG. 10, the position of the ice making unit 310 is inclined to the right with respect to an upper part of the first ice container 120 or at an upper center part of the first ice container 120. Therefore, in case of employing the twist-type ice making unit 310, the ice transported from the ice making unit 310 may vertically fall to a position inclined opposite to the ice forwarding unit 127 in the first ice container 120 or fall to the center of the first ice container 120.

When being received in the inclined position or in the center of the first ice container 120, the ice is hard to be moved to the second ice container 150. In addition, the ice full state of the first ice container 120 may be wrongly detected even before the ice is transported to the second ice container 150. Thus, it may be difficult to produce a quantity of ice and distributively store the ice into the first and the second ice containers 120 and 150.

To solve such a case, an extension rib 317 may be provided to be protruded upward from one side of the ice making tray 311.

The extension rib 317 may be integrally formed with the ice making tray 311 or separately formed and then connected to one side of the ice making tray 311.

The extension rib 317 guides the ice separated from the ice making tray 311 to fall near the ice forwarding unit 127.

As shown in FIG. 10, after the water stored in the ice making tray 311 becomes ice, the ice making tray 311 is rotated and twisted to separate the ice from the ice making tray 311. Through such operations and structure, the ice separated from the ice making tray 311 may slide along a slope of the extension rib 317 and fall to a position inclined to the ice forwarding unit 127.

Accordingly, since the ice fallen to the first ice container 120 is stacked from the position near the ice forwarding unit 127, the ice may be efficiently transported from the first ice container 120 to the second ice container 150 and stacked in the second ice container 150.

Thus, since the extension rib 317 guides the ice falling from the ice making tray 311 toward the ice forwarding unit 127, transportation of the ice from the first ice container 120 to the second ice container 150 can be effectively achieved.

That is, according to the structure of the another exemplary embodiment, the ice full state of the first ice container 120 will not be wrongly detected by the ice full state sensing lever 315 even when the second ice container 150 is not fully filled with the ice, thereby preventing a case where receiving of a quantity of the ice in the second ice container 150 is restricted in a non-ice full state.

Hereinafter, a refrigerator according to a further exemplary embodiment will be described.

One of the distinctive features of the further exemplary embodiment from the previous exemplary embodiments is in the structure of the second ice container.

Figure 11:
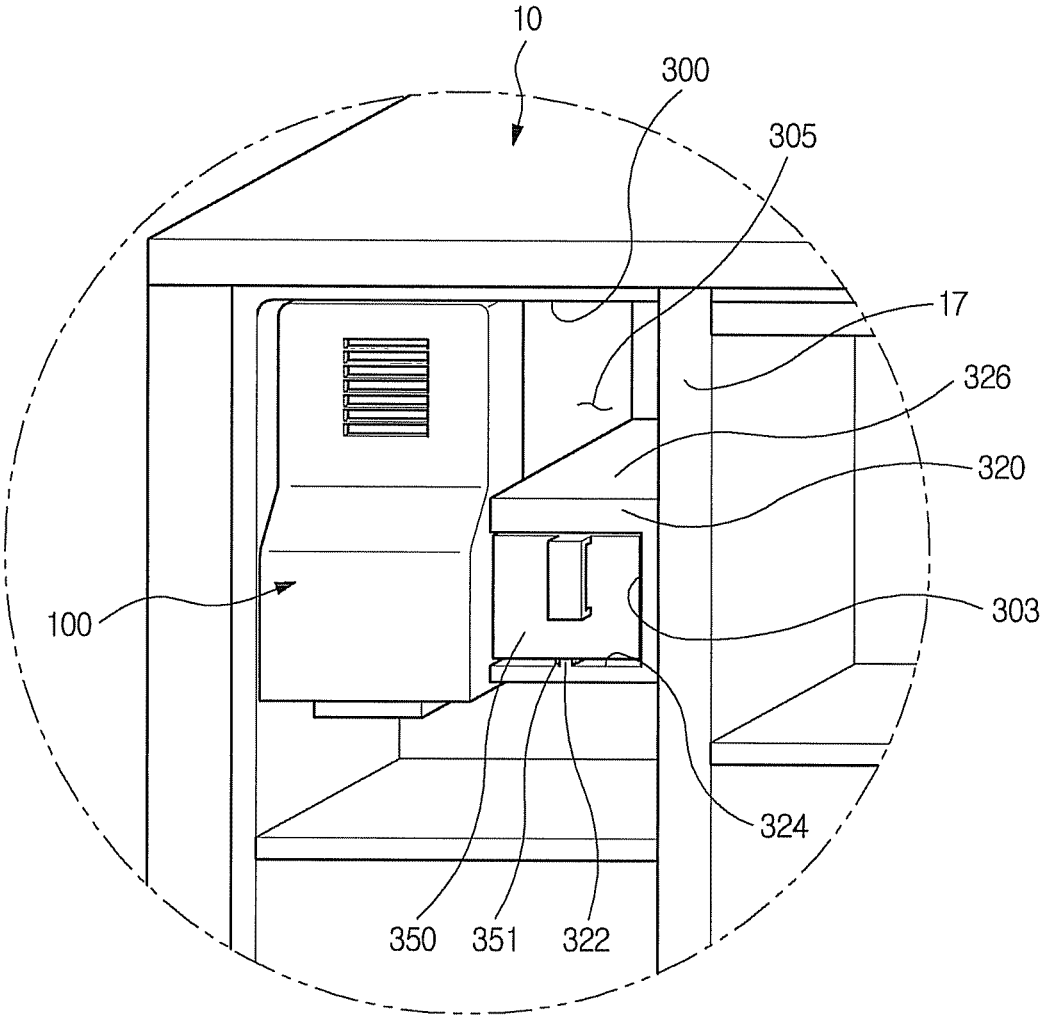
FIG. 11 illustrates a view showing main parts of the refrigerator according to a further exemplary embodiment.
Figure 12:
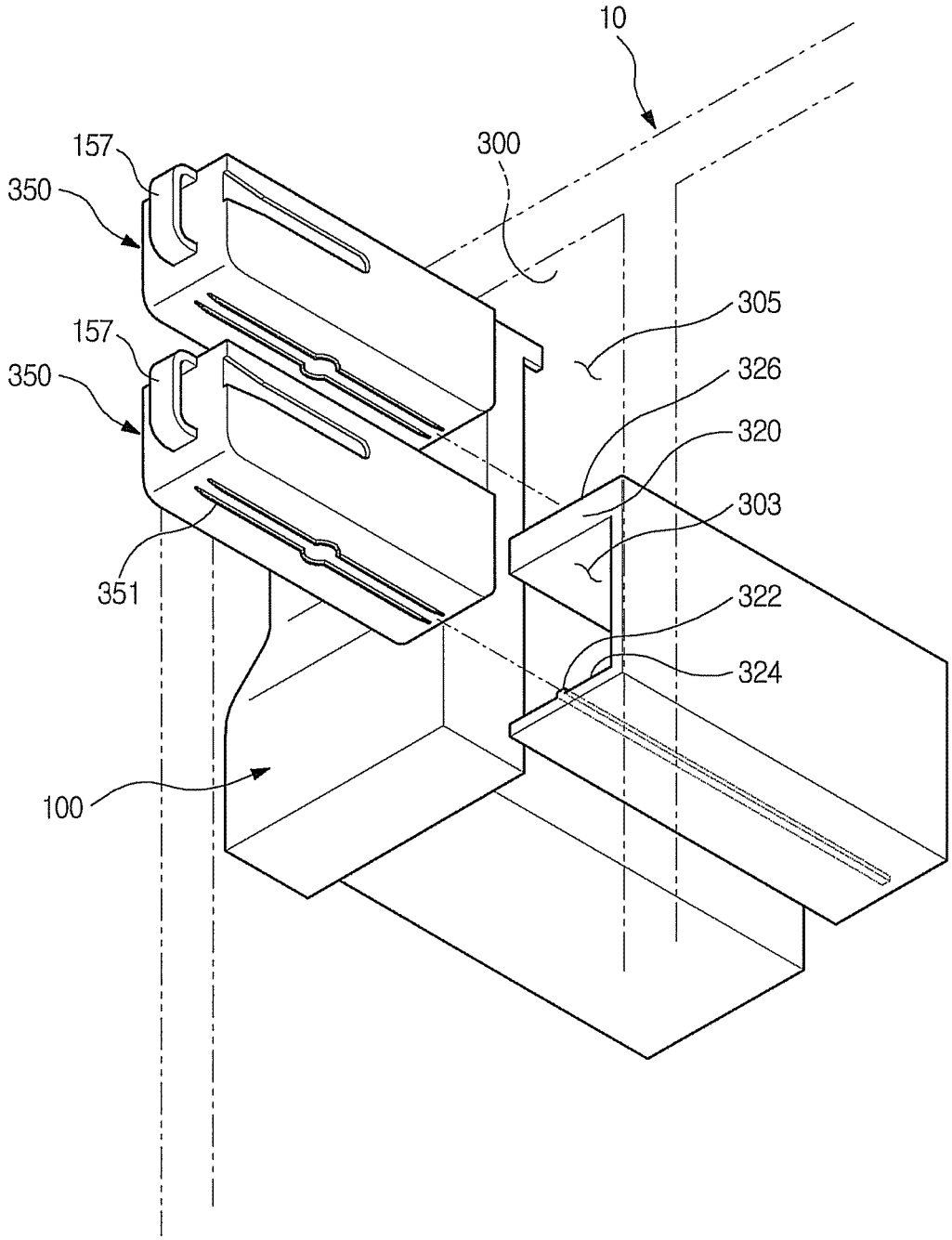
FIG. 12 illustrates a view showing a second ice container according to the further exemplary embodiment.

FIG. 11 shows main parts of the refrigerator according to the further exemplary embodiment and FIG. 12 shows the second ice container of the refrigerator, being connected, according to the further exemplary embodiment.

Compared to the second ice container 150 of the other exemplary embodiments, a second ice container 350 of the present exemplary embodiment further includes a rail part 351 formed at a lower surface thereof. The other structures are almost the same.

The rail part 351 is extended in a length direction along a lower outer surface of the second ice container 350. Therefore, when connected to one side of the first ice container 120

(FIG. 8 and FIG. 10), the second ice container 350 is guided to be smoothly connected while maintaining a substantially constant interval with the first ice container 120 along the length direction.

A guide 322 is correspondingly provided to a partition member 320 to guide the movement of the rail part 351. The partition member 320 will be described later.

The rail part 351 may be constituted by a pair of rails each having a predetermined width and extending in the length direction as protruded on the lower outer surface of the second ice container 350. The guide 332 is protruded by a predetermined height from a first supporting surface 324 of the partition member 320 and inserted between the pair of rails so as to guide the movement of the second ice container 350.

Although the present exemplary embodiment has the guide 322 at the partition member 320, if the partition member 320 is not provided and a supporting surface supporting the second ice container is dedicatedly formed as in the previous exemplary embodiments, the guide 322 may be formed at the supporting surface.

In addition, differently from the embodiment where the rail part 351 is formed at the second ice container 350 and the guide 322 is formed at the partition member 320, positions of the rail part 351 and the guide 322 may be exchanged.

Presuming that an ice making area 300 includes an area where the ice maker 100 is mounted and an area on the right of the ice maker 100 with respect to the drawing, the partition member 320 divides the right area of the ice maker 100 into upper and lower spaces.

That is, the partition member 320 divides the right ice making area into a first space 303 that is a lower space and a second space 305 that is an upper space.

The partition member 320 includes a first supporting surface 324 forming a lower side of the first space 303 and supporting the second ice container 350 which may be received in the first space 303, and a second supporting surface 326 forming a lower side of the second space 305 and supporting the second ice container 350 which may also be received in the second space 305.

Although the partition member 320 according to this exemplary embodiment integrally includes the first and the second supporting surfaces 324 and 326, the first and the second supporting surfaces 324 and 326 may be separately formed and connected to the right ice making area.

In the first supporting surface 324, the guide 322 corresponding to the rail part 351 formed on the lower surface of the second ice container 350 is extended in the length direction, thereby effectively guiding the second ice container 350 moving in and out with respect to the first space 303.

Referring to FIG. 3 and FIG. 11, the first and second spaces 303 and 305 are partitioned into predetermined spaces to receive the second ice container 350. More specifically, when the first guide unit 160 of the second ice container 350 puts the second ice container 350 into the first space 303 in a direction toward the first ice container 120, the rail part 351 formed at the lower surface of the second ice container 350 is guided by the guide 322 formed on the first supporting surface 324 and the second ice container 350 is accordingly connected maintaining the predetermined gap with the first ice container 120. Simultaneously, the opening and closing unit 200 of the first ice container 120 is moved down, thereby opening the ice forwarding unit 127.

On the other hand, when the second guide unit 170 of the second ice container 350 puts the second ice container 350 into the first space 303 in a direction toward the first ice container 120, the rail part 351 is guided by the guide 322 while a closed state of the ice forwarding unit 127 is maintained by the opening and closing unit 200. Accordingly, the second ice container 350 is connected, maintaining the predetermined gap with the first ice container 120.

In addition, multiple second ice containers 350 may used at the same time. In order to store a great quantity of ice, the second ice container 350 being full of ice by staying in the first space 303 for a predetermined time, may be taken out from the first space 303 and connected in the second space 305 as shown in FIG. 12. Then, an empty second container 350 may be newly mounted in the first space 303 so that a quantity of ice being produced by the ice maker 100 can be stored in the ice making area 300.

The refrigerator according to one or more embodiments may selectively employ the ice making units.

In addition, although a side-by-side (SBS) refrigerator has been explained, one or more embodiments may be applied to other types of refrigerators. Even in a refrigerator without an ice dispenser, large amounts of ice may be stored by providing first and second ice containers as set forth in the exemplary embodiments.

Although exemplary embodiments have been shown and described, it would be appreciated by those skilled in the art that changes may be made in these embodiments without departing from the principles and spirit of the invention, the scope of which is defined in the claims and their equivalents.

What is claimed is:

1. An ice maker comprising:

an ice making unit to receive water and to produce ice from the water;

a first ice container to receive the ice from the ice making unit;

an ice forwarding opening disposed at one side wall of the first ice container and configured to horizontally discharge the ice;

a second ice container detachably and horizontally connected to the first ice container and disposed beside the first ice container, the second ice container having a receiving portion formed at one side wall of the second ice container to forward the ice discharged from the ice forwarding opening within the first ice container, wherein a bottom of the ice forwarding opening and a bottom of the receiving portion are disposed at a same height in a state that the second ice container is connected to the first ice container, such that the ice is discharged through the ice forwarding opening and received in the second ice container when the first ice container is filled with the ice to a predetermined height.

2. The ice maker according to claim 1, wherein the ice forwarding opening guides ice discharged from the first ice container into the second ice container.

3. The ice maker according to claim 2, wherein the second ice container is detachably mounted to the one side of the first ice container.

4. The ice maker according to claim 3, further comprising an opening and closing unit to open the ice forwarding opening when the second ice container is mounted, and to close the ice forwarding opening when the second ice container is removed.

5. The ice maker according to claim 4, wherein the opening and closing unit comprises:

a shutter part; and an elastic member to supply elasticity to the shutter part in a direction for closing the ice forwarding opening.

6. The ice maker according to claim 4, wherein the opening and closing unit further comprises a shutter part and a guide shaft to guide movements of the shutter part.

7. The ice maker according to claim 2, wherein the second ice container comprises at least one handle unit.

8. The ice maker according to claim 5, wherein the second ice container comprises a first guide unit to move up and down the shutter part.

9. The ice maker according to claim 8, wherein the opening and closing unit comprises a projection protruded outward from the shutter part, and the first guide unit receives the projection and guides movements of the projection.

10. The ice maker according to claim 9, wherein the movements of the projection are up and down movements.

11. The ice maker according to claim 5, wherein one of the opening and closing unit and the second ice container further comprises a projection while the other one further comprises a first guide unit that receives the projection and guides movements of the projection.

12. The ice maker according to claim 8, wherein the first guide unit comprises:

an entry guiding part to guide entry of a projection; and an inclination part inclined downward from the entry guiding part.

13. The ice maker according to claim 12, wherein the first guide unit further comprises a movement prevention part extended from the inclination part to prevent the projection from moving.

14. The ice maker according to claim 2, wherein the second ice container further comprises a step part disposed at a similar height as the ice forwarding opening.

15. The ice maker according to claim 8, wherein the second ice container further comprises a second guide unit to receive a projection and to maintain a closed state of the opening and closing unit during mounting and removal of the second ice container.

16. An ice maker comprising:

a first ice container to receive ice, the first ice container comprising an ice forwarding opening disposed at one side wall of the first ice container and configured to guide discharge of the received ice;

a second ice container detachably and horizontally connected to the first ice container and disposed beside the first ice container;

a step part formed at one side wall of the second ice container and stepped down to forward the ice discharged from the ice forwarding opening within the first ice container; and an opening and closing unit configured to open the ice forwarding opening when the second ice container is connected in a first direction, wherein the ice forwarding opening is disposed at a predetermined height such that the ice is discharged through the ice forwarding opening and received in the second ice container, when the first ice container is filled with the ice to the predetermined height.

17. The ice maker according to claim 16, wherein the opening and closing unit comprises:

a shutter part; and an elastic member to supply elasticity to the shutter part in a direction for closing the ice forwarding opening.

18. The ice maker according to claim 17, wherein the opening and closing unit comprises a projection, and the second ice container comprises a first guide unit that receives the projection to guide movements of the projection when the second ice container is connected in the first direction.

19. The ice maker according to claim 18, wherein the first guide unit comprises:

an entry guiding part to guide entry of the projection; and an inclination part inclined downward from the entry guiding part.

20. The ice maker according to claim 18, wherein the second ice container further comprises a second guide unit that receives the projection and maintains a closed state of the opening and closing unit when the second ice container is connected in a second direction.

21. A refrigerator comprising:

a main body forming an exterior appearance;

an ice maker installed within the main body, wherein the ice maker comprises an ice making unit to receive water and to produce ice from the water, a first ice container to receive the ice separated from the ice maker;

a second ice container detachably and horizontally connected to the first ice container and disposed beside the first ice container to receive ice discharged from the first ice container;

a step part formed at one side wall of the second ice container and stepped down to forward the ice discharged from an ice forwarding opening within the first ice container; and a bottom of the ice forwarding opening and a bottom of a forwarding portion are disposed at a same height when the second ice container is connected to the first ice container.

22. The refrigerator according to claim 21, further comprising an opening and closing unit to open the one side of the first ice container when the second ice container is connected, and to close the one side of the first ice container when the second ice container is separated.

23. The refrigerator according to claim 22, wherein the opening and closing unit comprises a shutter part disposed at the one side of the first ice container and including a projection, and an elastic member to supply elasticity to the shutter part in a direction for closing the one side of the first ice container, and the second ice container comprises a first guiding unit to receive the projection and to guide up and down movements of the projection.

24. The refrigerator according to claim 21, wherein the one side of the first ice container is opened when the second ice container is connected to the first ice container on one side of the second ice container, and the one side of the first ice container is closed when the second ice container is connected to the first ice container on another side of the second ice container.

25. A refrigerator comprising an ice maker and a dispenser to discharge ice from the ice maker, wherein the ice maker comprises:

an ice making unit to produce ice;

a first ice container to receive the ice from the ice making unit;

an ice forwarding opening disposed at one side wall of the first ice container and stepped down from a top of the first ice container;

a transport unit mounted in the first ice container to transport the ice to the dispenser;

a second ice container detachably mounted and disposed beside the first ice container along a horizontal plane;

a step part formed at one side wall of the second ice container to forward the ice discharged from the ice forwarding opening within the first ice container; and an opening and closing unit provided to at least one of the first and the second ice containers to open one side of at least one of the first and the second ice containers when the second ice container being detachably mounted, the ice moves horizontally between the ice forwarding opening and the step part, when the first ice container is filled with the ice to a predetermined height.

* * * * *

UNITED STATES PATENT AND TRADEMARK OFFICE

CERTIFICATE OF CORRECTION

PATENT NO. : 9,188,377 B2
APPLICATION NO. : 12/538349
DATED : November 17, 2015
INVENTOR(S) : Sang Geun Choi et al.

It is certified that error appears in the above-identified patent and that said Letters Patent is hereby corrected as shown below:

IN THE SPECIFICATION

Column 1, Line 9

Delete "10-2009-0055.046" and insert --10-2009-0055046--, therefor.

Signed and Sealed this
Ninth Day of February, 2016

Michelle K. Lee

Michelle K. Lee
*Director of the United States Patent and Trademark Office*